US008286577B2

(12) United States Patent
Eriksson et al.

(10) Patent No.: US 8,286,577 B2
(45) Date of Patent: Oct. 16, 2012

(54) DEVICE AND METHOD FOR COATING

(75) Inventors: Tore Eriksson, Klassbol (SE); Hakan Karlsson, Saffle (SE)

(73) Assignee: Mattssonforetagen I Uddevalla Aktiebolag, Uddevalla (SE)

( * ) Notice: Subject to any disclaimer, the term of this patent is extended or adjusted under 35 U.S.C. 154(b) by 767 days.

(21) Appl. No.: 11/989,865

(22) PCT Filed: Aug. 30, 2006

(86) PCT No.: PCT/SE2006/050305

§ 371 (c)(1),
(2), (4) Date: Jun. 19, 2009

(87) PCT Pub. No.: WO2007/027150

PCT Pub. Date: Mar. 8, 2007

(65) Prior Publication Data

US 2010/0009088 A1 Jan. 14, 2010

(30) Foreign Application Priority Data

Aug. 30, 2005 (SE) ..... 0501910

(51) Int. Cl.
*B05C 1/08* (2006.01)
*B05D 1/28* (2006.01)

(52) U.S. Cl. ..... 118/110; 118/118; 118/119; 118/126; 118/211; 118/212; 118/262; 118/414; 427/428.09; 427/428.1; 427/428.12; 427/428.14; 427/428.17; 427/428.2; 427/428.21

(58) Field of Classification Search ..... 118/110, 118/118, 119, 126, 211, 212, 262, 414; 427/428.09, 427/428.1, 428.12, 428.14, 428.17, 428.2, 427/428.21
See application file for complete search history.

(56) References Cited

U.S. PATENT DOCUMENTS 3,635,158 A 1/1972 Budinger
(Continued)

FOREIGN PATENT DOCUMENTS

DE 37 03 834 A1 8/1988
(Continued)

OTHER PUBLICATIONS

Communication dated Apr. 2, 2008 with cited references which issued in corresponding Swedish Application, Patentansokan nr 0501910-4 (4 pgs).

(Continued)

*Primary Examiner* — Laura Edwards
(74) *Attorney, Agent, or Firm* — Jeffrey S. Melcher; Manelli Selter PLLC

(57) ABSTRACT

A dosing device for the application of a coating mix (6) onto a running web, in particular a paper or paperboard web (1), which device comprises a rod (8) that is supported revolvingly over its entire length in a rod cradle (12), and a pressing device (13) acting on the rod cradle and producing a pressure of the rod onto the web (1) and onto the holding-on device (2, 17, 15) of the web, the rod (8) being provided with a wear resistant surface coating (15) with a hardness of about 10 to about 100 according to Shore A. The invention also relates to methods of using said rod, and to said revolving rod.

17 Claims, 7 Drawing Sheets

U.S. PATENT DOCUMENTS

| | | | | |
|---|---|---|---|---|
| 3,931,786 | A | 1/1976 | Teed | |
| 4,061,109 | A | 12/1977 | Allen | |
| 4,757,782 | A * | 7/1988 | Pullinen | 118/411 |
| 4,981,726 | A | 1/1991 | Rantanen et al. | |
| 5,264,247 | A | 11/1993 | Lintula | |
| 5,595,601 | A | 1/1997 | Lintula | |
| 6,183,079 | B1 * | 2/2001 | Meade et al. | 347/101 |
| 6,312,520 | B1 * | 11/2001 | Eriksson et al. | 118/106 |
| 2002/0148580 | A1 | 10/2002 | Sugihara et al. | |

FOREIGN PATENT DOCUMENTS

| | | | |
|---|---|---|---|
| DE | 19626580 | A1 | 1/1998 |
| EP | 0571351 | A1 | 11/1993 |
| EP | 1234912 | A2 | 8/2002 |
| GB | 1411198 | | 10/1975 |
| WO | WO 00/58555 | | 10/2000 |
| WO | WO 00/58555 | A1 | 10/2000 |
| WO | 03078077 | A1 | 9/2003 |

OTHER PUBLICATIONS

Subhash, V.G.; Perfluorinated Polymers: Kirk-Othmer Encyclopedia of Chemical Technology; Aug. 13, 2004 (D3).

Calce; Mar. 19, 2008; imp://www.calce.umd.edu/general/Facilities/Hardness_ad_.htm#3.5> Figure 5 och 7 (D4).

Swedish Office Action; Application No. 0501910-4 dated Jun. 4, 2008 (4 pages).

Supplementary European Search Report (completed Dec. 15, 2011) for corresponding European application.

* cited by examiner

Fig. 3
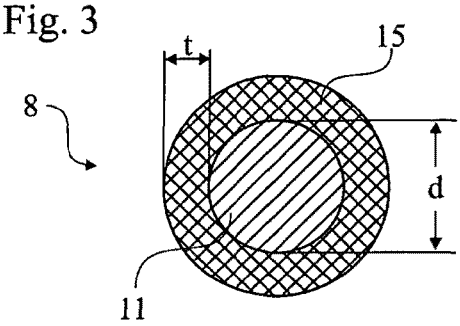
Fig. 3A
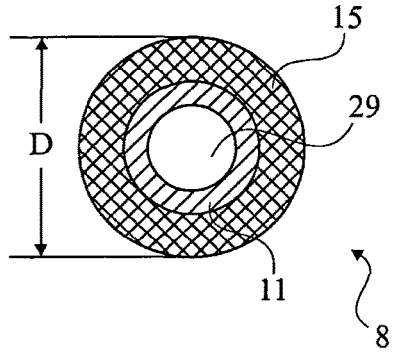
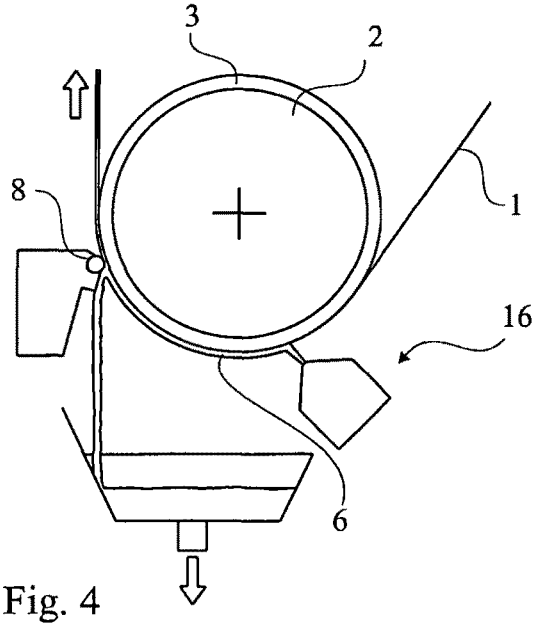
Fig. 4
Fig. 5
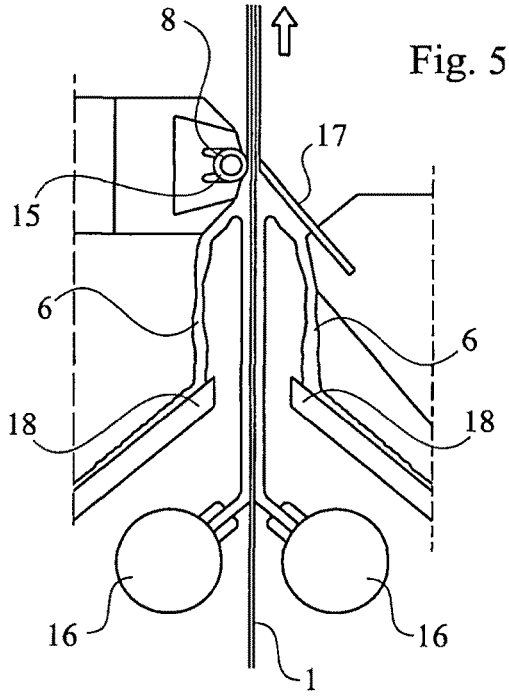

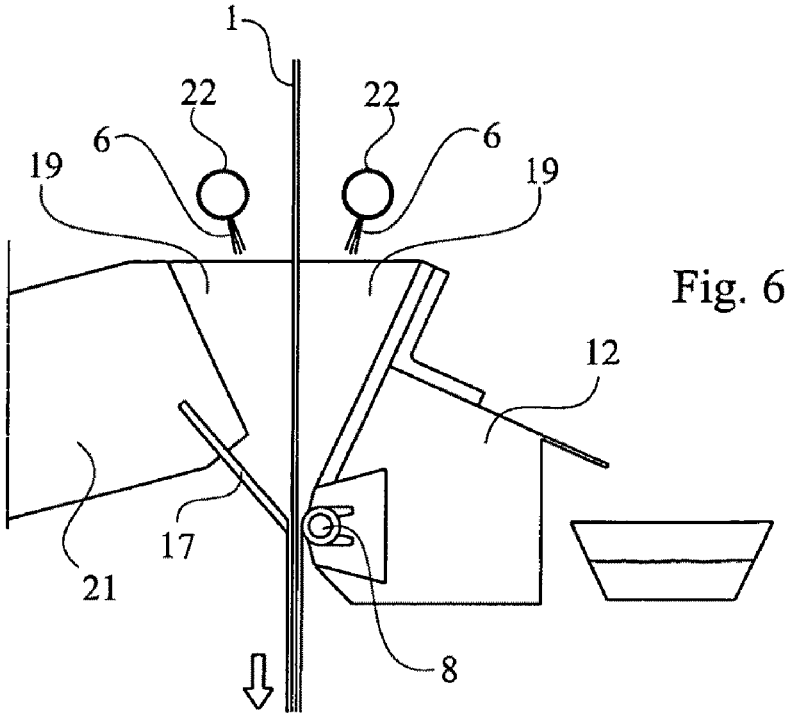
Fig. 6
Fig. 7
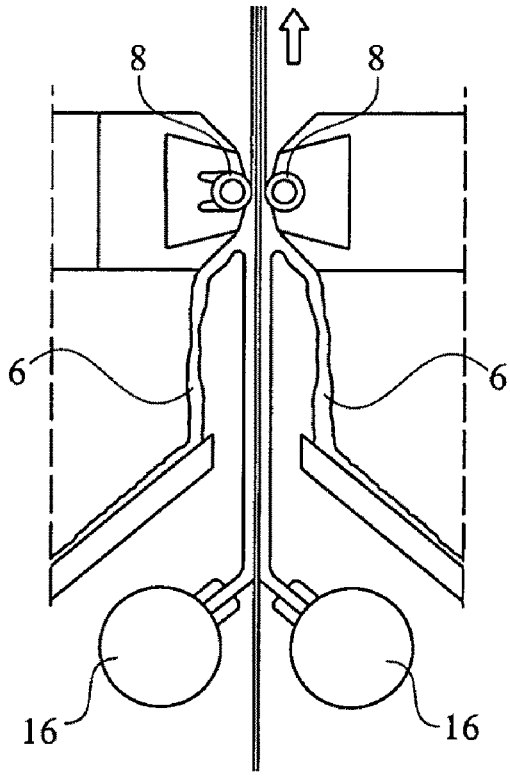

DEVICE AND METHOD FOR COATING

This application is the U.S. National Phase of International Application PCT/SE2006/050305, filed 30 Aug. 2006, which designated the U.S. PCT/SE2006/050305 claims priority to Swedish Application No. 0501910-4 filed 30 Aug. 2005. The entire content of these applications are incorporated herein by reference.

TECHNICAL FIELD

The present invention relates to a dosing device for the application of a coating mix onto a running web, in particular a paper or paperboard web, which device comprises a rod that is supported revolvingly over its entire length in a rod cradle, and a pressing device that produces a pressure of the rod onto the web and onto the counter pressing device of the web. The invention also relates to a revolving rod for the application of a coating mix onto a running web. The invention also relates to methods for coating by use of the revolving rod according to the invention.

PRIOR ART

The traditional technique of coating with a revolving rod (see e.g. EP 0 541 502) is based on a revolving rod that is supported over its entire longitudinal direction in a rod cradle and that doses the coating mix onto the running web. The revolving rod is made of steel and is usually provided with a wear resistant surface coating of a hard material such as chromium or a ceramic material. The diameter of the rod normally varies from about 10 mm to about 75 mm. The rotary direction of the rod is usually against the running direction of the web. The most significant feature of the revolving rod concept is that the rod is not self-supporting but that it must be carried in a rod cradle over its entire longitudinal direction. The rod cradle is usually manufactured from a soft material such as rubber or plastics. Inside the rod cradle there is one or more longitudinal grooves for water lubrication of the revolving rod.

Since it is the primary task of the coating rod to level out and wipe off any excess of a coating liquid containing hard particles such as titanium dioxide and/or calcium carbonate, the rod is exposed to continuous wear. The wear could also depend on particles in the running web. When the rod has experienced a certain degree of wear, it needs to be replaced. Such exchanging of rods implies large costs, partly due to the cost of the rod itself and partly due to the loss of production caused by the exchanging of rods.

Due to the above reasons, it has therefore been important to use rods with a face that is as wear resistant as possible. This has caused the manufacturers of the rods to strive to make the faces of the rods as wear resistant as possible by increasing the hardness of the face by means such as hardening or surface coating with chromium or ceramic materials.

The hard face of the rod means however that the quality of the coating layer will not be optimal in some fields of application for the technique. Such quality defects are caused by the running web, normally of paper or paperboard, not having a completely smooth surface. When the rod with its hard and inflexible face doses out the coating mix, an effect of "puttying" is caused which brings about patchiness in the coating layer by local variations in thickness of the coating layer.

From DE 3703834 is known a method and a device that fall within the scope of the just mentioned strive of development, i.e. a revolving rod that is provided with a friction decreasing and wear resistance increasing surface coating, which is achieved e.g. by surfacing the rod with diamond in order to obtain a Vicker hardness of between 6,000 and 10,000 in a very thin layer, i.e. 1 nm to 90 μm. Accordingly, DE 3703834 has nothing to do with the above mentioned problem.

A revolving rod is also known from WO 00/58555, aiming to minimize the risk of formation of streaks in the coating. By streaks is understood, to the skilled person within the present technical field, relatively wide, normally over 4 mm wide, stripes that can be formed in the coating and that constitute a discernible visual difference, which streaks follow the running direction of the web. Accordingly, this means something totally different from a puttying effect. The solution to this problem is achieved by manufacturing the revolving rod with a relatively narrow inner core and a surface coating outside the core, which surface coating is provided with a lower modulus of elasticity than the core in order to achieve a lower bending resistance of the revolving rod. PTFE and PVC are recommended as surface coating materials. Of course, these materials have modulus of elasticity considerably lower than the one for steel, but all the same they are relatively hard materials. Such hard materials fall outside the possibility of being measured by the Shore A method that is based on the material being penetrable enough for a durometer to penetrate into the material. Rigid PVC and PTFE materials are hence measured by completely different hardness methods such as Rockwell and Vicker, as is mentioned in the description.

Accordingly, there is a need for improvements in the present field as there is a lack of devices/methods that are efficient in minimizing the puttying effect.

BRIEF ACCOUNT OF THE INVENTION

The main object of the invention is to provide a dosing device, a revolving rod and a method according to the claims, which will result in qualitative advantages in respect of the applied coating and a maintained or improved life span of the revolving rod. Another object of the invention is, thanks to the new properties of the rod, to be able to increase its fields of use with new coating concepts. To fulfil these and other objects that will be clear from the following description, the present invention provides a revolving coating rod for the application of a coating mix, water, or some other agent for changing the surface properties of the running web, onto a running web.

Tests performed, using the technique according to the present invention, have shown that surprising improvements are achieved in comparison with conventional technique in respect of the coating's quality and runnability (i.e. a lower web break frequency) with a maintained or improved life span of the revolving rod.

The soft surface coating of the revolving rod results in better compliance with the more or less rough paper surface and hence it results in decreased "puttying" effect and thereby a better coating of the fibres.

The cause of the improved runnability is probably that due to the soft surface of the rod being deformed by the particles it will more easily will let particles pass, which particles may be present in the paper or paperboard web, or in the coating mix. Directly after the passage of a particle, the surface coating material will then return to its initial position.

According to a preferred embodiment and device according to the invention, the material in the surface coating used for the revolving rod has a modulus of elasticity of less than 15 $N/mm^2$, preferably between 0.1 and 10 $N/mm^2$.

In the following, the invention will be described in the context of running webs of paper or paperboard e.g. It is however not limited thereto but can be used in connection with all types of running webs.

The revolving rod according to the invention suitably comprises a core of a dimensionally stable material such as steel. The core of the rod, being homogeneous or tubular, is surface coated with a soft wear resistant material.

The outer diameter of the rod is 6-100 mm. In a preferred embodiment of the invention, the diameter of the rod is 8-50 mm.

The soft surface coating material may have a thickness of 0.5-10 mm, but a preferred thickness range is 2-5 mm.

The hardness of the surface coating is specified in Shore A and may be in the range of from 10 and up to close to 100, but with known materials of today it will probably be in the range of from 50 to 95 Shore A. In a preferred embodiment of the invention, the hardness of the surface coating is in the range of 30-90 Shore A, particularly in the range of 30-80.

In special embodiments of the invention, the surface coating of the rod has an embossed surface. The embossment may for example be parallel radial grooves, like a screw thread, or it may exhibit spot-wise depressions like the surface of rotogravure plates.

The findings that lay the basis of the present invention, i.e. the fact that advantages can be attained by using a relatively soft rod surface coating, at the same time achieving an acceptable life span, results in the additional advantage that the surface coating material can be an organic polymer. Examples of useful polymers are polyurethanes, styrene-butadiene polymers, i.e. rubber type polymers, as well as polyolefins.

Particularly preferred polymers are polyuretanes, the building blocks of which are formed of polyoles and diisocyanates, as is conventional. Common diisocyanates for polyurethane systems are toluene diisocyanate, diphenylmethane diisocyanate and naphtalene diisocyanate. Less usual diisocyanates also exist, such as hexamethyl diisocyanate and isophorone diisocyanate. Polyurethanes exist for example as ester urethanes, ether urethanes and urethanes based on hydroxyl terminated polybutadienes. The type of polyurethane used in the present invention is not decisive of the practical result, which is instead, to a much higher degree, determined by its hardness.

Advantages similar to the above described are also found in blade coating using blades having a soft tip surface coating, which is described in SE 507 926. The drawback of that method is that the soft surface coating is sensitive to dry friction, i.e. that the blade (intentionally or unintentionally) scrapes against a dry paper surface of the web (before a coating mix is applied). The soft surface coating will then quickly be damaged by the frictional heat, most often leading to cassation.

By application of the present invention, such problems will be diminished or even eliminated, by the rod revolving such that its surface gets lubricated and cooled by the lubrication grooves in the rod cradle. The lubricating agent is usually water but an improved lubricating and cooling effect can be achieved by addition of lubricating and cooling enhancing additives to the water.

The present invention will also enable novel coating concepts, which is clear from the following description.

BRIEF DESCRIPTION OF THE DRAWINGS

In the following, the invention will be exemplified by non-limiting examples with reference to the appended drawings, of which:

FIGS. 3 and 3A show a cross-section of two alternative revolving rods according to preferred embodiments of the invention, coated with a soft material.

FIG. 4 shows an alternative method according to the invention, in which the soft rod according to the invention is used in combination with a counter pressing roll having a hard surface.

FIG. 5 shows a method according to the invention, in which the soft rod is used for two-sided coating in which the running direction of the web is essentially vertically upwards.

FIG. 6 shows the same principal method as in FIG. 5, but in which the running direction of the web is essentially vertically downwards.

FIG. 7 shows a method according to the invention, in which the web that has received an excess of coating liquid is fed forward between dosing devices that on both sides are constituted by soft revolving rods.

DETAILED DESCRIPTION

Figure 1:
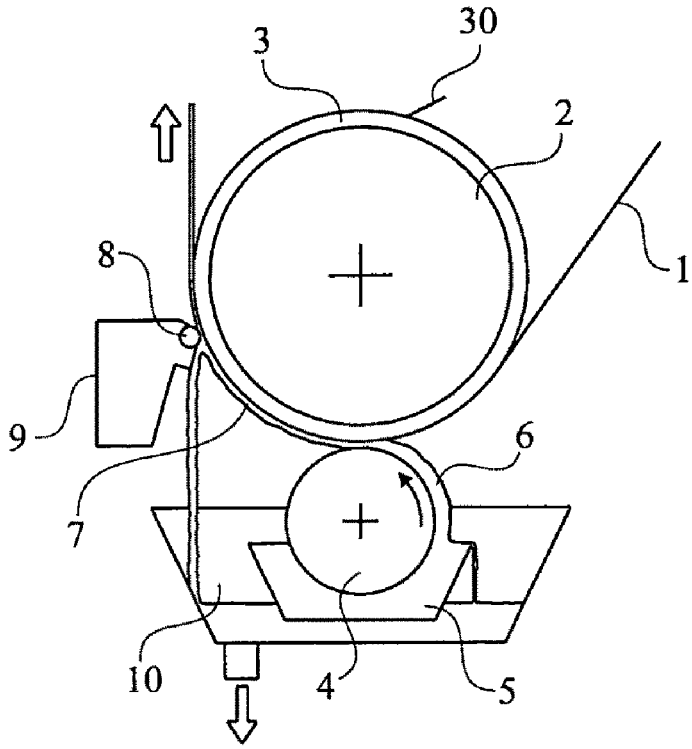
FIG. 1 shows a coating device for single side coating in which a soft revolving rod according to the invention is used as a dosing device in combination with a counter pressing roll having a hard surface.

FIG. 1 shows a revolving rod 8 with a counter pressing roll 2 having a hard surface 3. The coating mix 6 is applied in excess to the web 1 by a traditional method. The figure shows an example of a method of application in which an application roller 4 is submerged in a tray 5 with the coating mix 6. When the roller 4 is rotated, coating mix 6 is fed to the gap formed between the counter pressing roll 2 and the application roller 4. In this nip excess dosing takes place.

The pre-dosed coating layer 7 is then given its final dosing by the soft rod 8. The rod unit is mounted on a carrier beam 9. The excess of coating mix 6 is led via a collecting tray 10 to a traditional circulation system. The surface of the counter pressing roll 2 can easily be kept clean by use of a traditional cleaning doctor blade 30, which for example can be counter positioned as is schematically shown in FIG. 1.

In traditional use of a revolving rod, the hard rod is abutting the paper surface. A roll with a rubber running surface is then used as counter pressure for the paper web. When using the rod according to the invention it has been shown possible—thanks to the surface of the rod being non-rigid—to use a counter pressing roll having a hard surface. Hence, large cost savings can be achieved by eliminating high costs for rubber surface coatings, redressing, recovering and by decreased costs for exchanging of rolls. The roll surface can also be kept clean more easily by using a traditional cleaning doctor blade.

Figure 2:
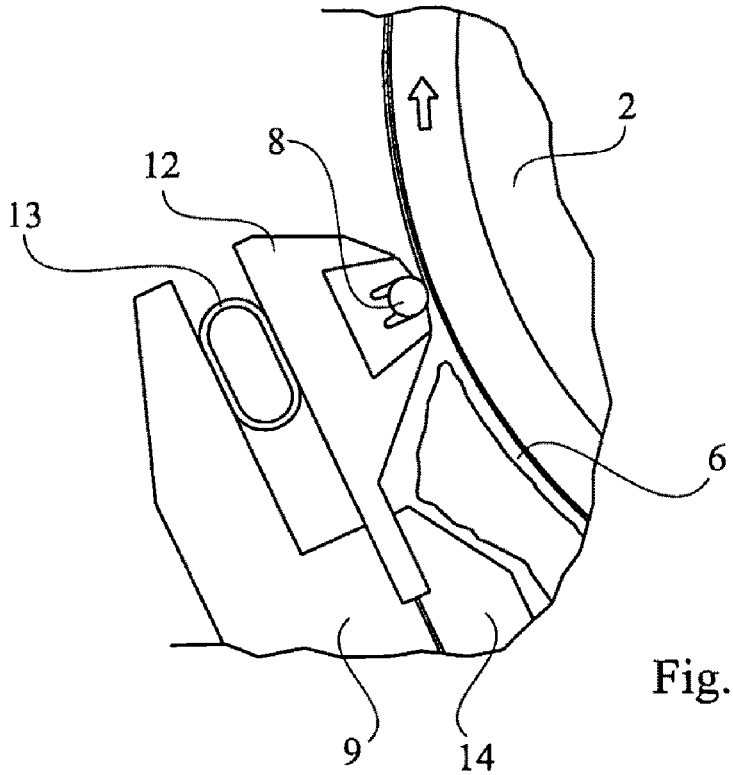
FIG. 2 shows a magnification of the dosing device in FIG. 1.

FIG. 2 shows a magnification of the rod unit in FIG. 1, comprising the revolving rod 8 that is supported over its entire length in a rod cradle 12 that can be of conventional type with a pneumatic pressing device 13, which could however also be of hydraulic or mechanical type. FIG. 2 shows an example of a pneumatic type in which the pressure is generated by a pressurised flexible tubing 13 by which the pressing of the rod 8 against the roll 2 can be controlled such that a desired dosing of the coating mix 6 is achieved. The rod cradle 12 is clamped in the carrier beam 9 by the clamping jaw 14.

FIG. 3 shows a cross-section of a rod 8 having a homogeneous rod core 11 outside of which the soft running surface 15 is applied according to the present invention. FIG. 3A shows that the rod core 11 alternatively could be formed by a hole-profile, i.e. a tubular core 11 with a through hole 29. The outer diameter d of the core is suitable in the range of 4-95 mm.

The core 11 is preferably made of a dimensionally stable material such as steel, aluminium or a suitable composite. The outer diameter D of the rod can be 6-100 mm. In a preferred embodiment of the invention, the diameter of the rod is 8-50 mm.

The surface coating 15 is made of a soft and wear resistant material, the outer surface of which preferably being smooth but in some applications being embossed. The thickness t of the soft surface coating material 15 can be 0.5-20 mm, but a preferred thickness range is 1.5-7 mm, more preferably 2-5 mm. In a preferred embodiment, the hardness of the surface coating is in the range of 30-95 Shore A, more preferred 30-80 Shore A. In a preferred form of the invention, the surface coating material 15 is made of an organic polymer, having a Shore A value of about 70. Particularly preferred polymers are polyuretanes, the building blocks of which are formed of polyoles and diisocyanates, as is conventional.

FIG. 4 illustrates an alternative method of using the soft revolving rod 8 according to the invention, in combination with a hard counter pressing roll 2, i.e. a counter pressing roll having a hard outer surface 3 of steel e.g. Here, pre-dosing of the coating mix 6 onto the web 1 takes place by a so called jet fountain applicator 16 in which the coating mix 6 is sprayed onto the web 1 by a longitudinal spray nozzle, as is known per se, where after a final dosing is achieved in accordance with the above described, by the soft rod 8. FIG. 5 shows a method according to the invention, for two-sided coating of a web 1, where the dosing device is formed on one side by coating blades 17 of traditional type, e.g. of homogeneous steel or steel blades having wear surfaces coated with hard or soft materials. On the other side, the dosing device is formed by a revolving rod 8 having a soft running surface 15 according to the invention. The coating mix 6 that in the example according to the drawing is applied by so called fountain applicators 16, is transported along with the running web 1. The web 1, which has received an excess of coating mix 6, is fed forward between the opposed dosing devices 8, 17. In this case, the running direction of the web 1 is essentially vertically upwards. The coating mix 6 can have the same composition on both sides or it can be of different compositions, and of course it can be varied within wide boundaries depending on the purpose of the coating. In some cases, the coating mix 6 can be just water on one side, in order to prevent "curl", i.e. with the purpose of achieving a planar final sheet of paper.

The coating mix excess 6 from the dosing devices is led to the circulation system via guide plates 18.

FIG. 6 shows a method for two-sided coating, which is principally the same as the one shown in FIG. 5, but having a downward web running direction. The drawing shows that the web 1 is led downwards through an accumulation of coating mix 19 formed between the holders 21 and 12, respectively, for the blade 17 and the revolving rod 8, respectively. The coating mix 6 is supplied via supply conduits 22.

In a known conventional type of two-sided coating, the paper web 1 is fed forward through a nip formed between two opposed blades 17. A known problem in connection with this method is the difficulty in getting the coating blades on the two sides to meet tip to tip. Deviations from such a position result in variations in the applied amount of coating mix, which is undesired. By replacing the blade on one side by a revolving rod 8 according to the present invention (see FIG. 5), it has proved possible to fulfil surprisingly high demands on coating quality similarity on the two sides. Hence, the invention eliminates the above mentioned problems that were related to the requirement of getting the opposed blades to meet precisely tip to tip.

Another known traditional method for two-sided coating is to feed the paper web 1 through a nip between a blade and a rubber coated counter pressing roll. Besides having to supply coating mix to one side of the web, before the blade, coating mix also has to be supplied to the side with the roll, in a fairly complicated manner. This is because the dosing of the coating mix on the side with the roll must take place between the surface of the large counter pressing roll and the paper surface. In case of a web running downwards, the coating mix is added in the pocket formed between the paper web and the roll. In case of a web running upwards, separate applicators must be used. It is realised that this traditional method is combined with a plurality of difficulties and disadvantages. By replacing the rubber coated counter pressing roll with a revolving rod (see FIG. 6) advantages can be attained in respect of space, cost and quality.

Another method according to the invention, for two-sided coating, is illustrated in FIG. 7. According to this method the dosing takes place in a nip formed between two opposed rods 8 with soft running surfaces 15. The figure shows a web 1 running upwards onto which a pre-dosing of the coating mix 6 takes place by fountain applicators 16. Of course the method can, within the scope of the invention, be used in connection with a web running downwards. In the latter case, the application of coating mix 6 takes place in accordance with the principle shown in FIG. 6. By the revolving rods 8 in accordance with the invention having soft surfaces 15, it has proven surprisingly simple to accomplish a two-sided coating with high quality demands.

Figure 8:
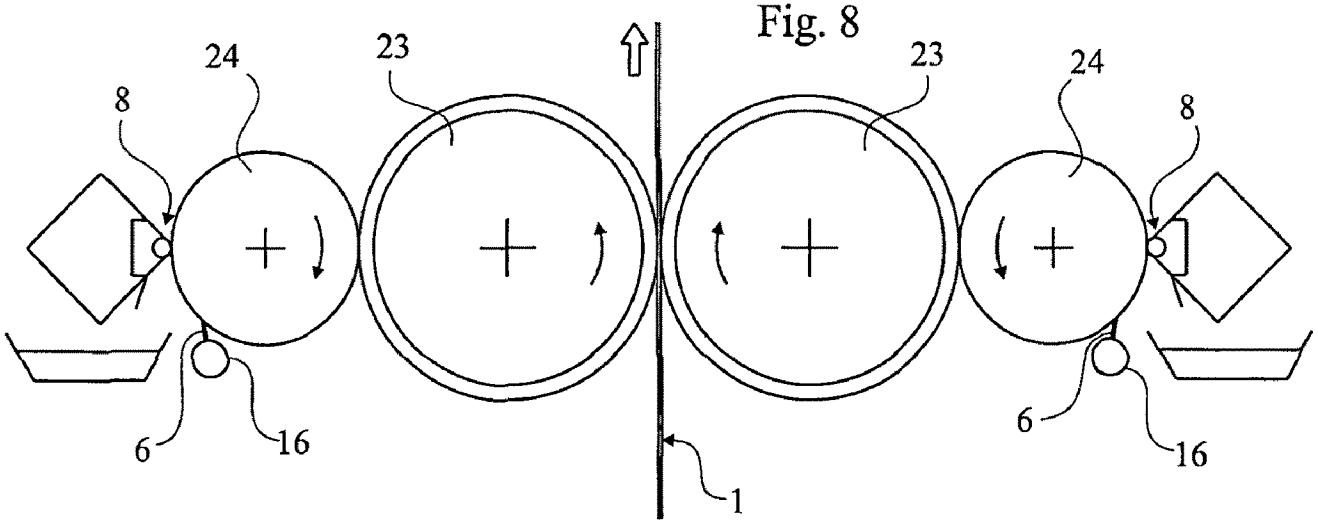
FIG. 8 shows a method according to the invention, in which the soft rod according to the invention is used as a dosing device for so called transfer coating machines. In this case, the web is running upwards.

Another method for two-sided coating is illustrated in FIG. 8, in which a coating mix 6 is applied in a pattern on a web 1 running upwards in the nip between two rubber coated transfer rolls 23. The coating mix 6 is supplied to the transfer rolls 23 via gravure rolls 24, the gravure pattern of which gets a final dosing of coating mix 6 by revolving rods 8 having a soft coating according to the invention. The pre-dosing of the coating mix 6 onto the gravure rolls 24 takes place by fountain applicators 16 that are suitably arranged just before the position of the respective revolving rods 8.

A soft or hard blade is traditionally used as a final dosing element in connection with a gravure roll. By instead using the soft rod according to the invention, the risk of damages or wear, respectively, is decreased and/or eliminated since, as has already been mentioned, the soft blade is very sensitive to unintentional dry friction and the hard blade results in wear on the gravure roll, respectively.

Figure 9:
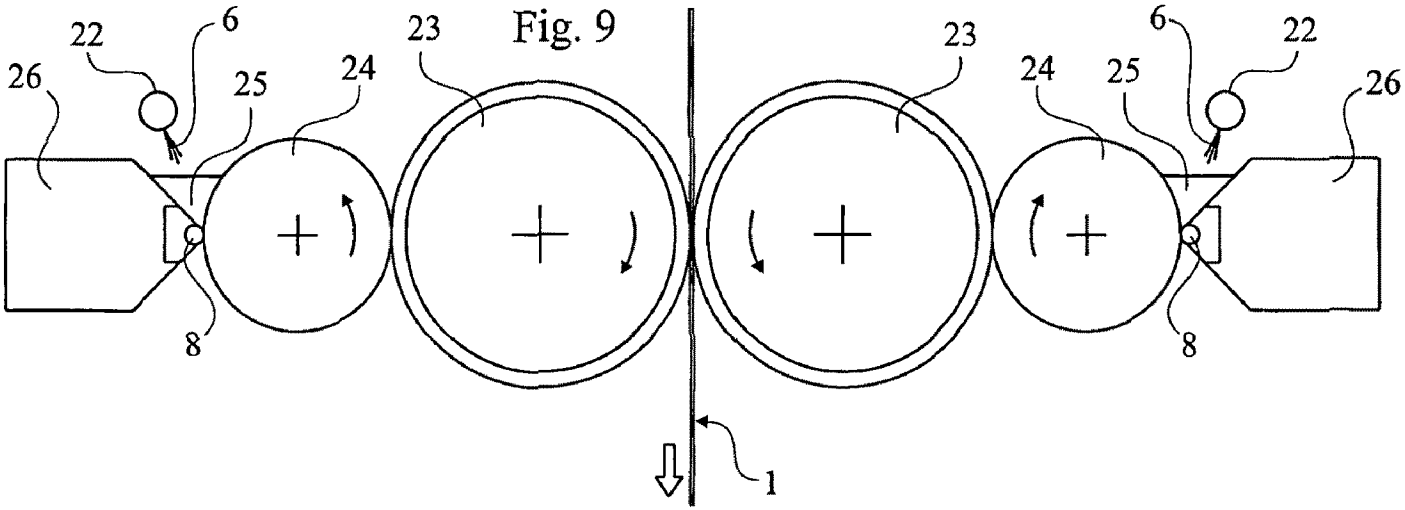
FIG. 9 shows the same principal method as in FIG. 8, but in which the running direction of the web is vertically downwards.

FIG. 9 shows web coating according to the above described principle, in connection with a web 1 running downwards. In this case, the supply of coating mix 6 takes place by supplying it via supply conduits 22 to the pocket 25 formed between the gravure rolls 24 and the holders 26 for the revolving rods 8.

The perhaps most important advantage attained when using a soft rod (e.g. as compared to a hard rod) is the above mentioned quality advantages including decreased patchiness and better covering of the fibres.

This has been verified by extensive pilot tests whereof 2 tests are accounted for below.

The following operational data were used in both tests.

| | |
|---|---|
| Machine speed: | 600 m/min |
| Amount applied: | 14 g/m$^2$ |
| Dry solids content of the coating mix: | 62% |
| Viscosity of the coating mix: | 650 cp |

Figure 10:
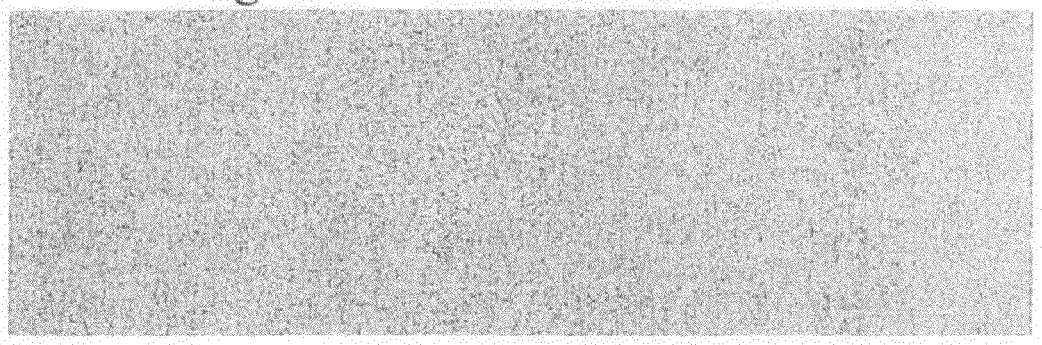
FIGS. 10-13 show the results of comparative tests made with a soft surface and a hard surface, respectively.
Figure 11:
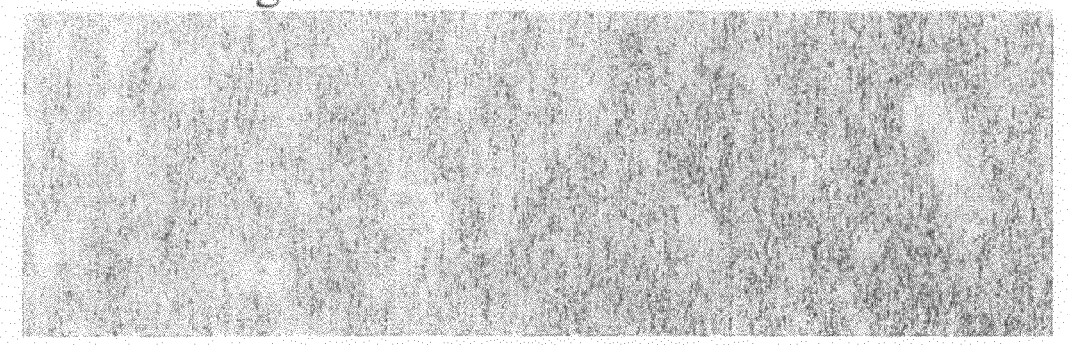

In experiment 1 (see FIGS. 10 and 11) a direct comparison was made between the use of a rod according to the invention and a traditional rod for the coating of paperboard, here a base paperboard of 270 g/m$^2$. FIG. 10 shows the result of coating with a soft rod and FIG. 11 shows the result of coating with a hard rod.

Figure 12:
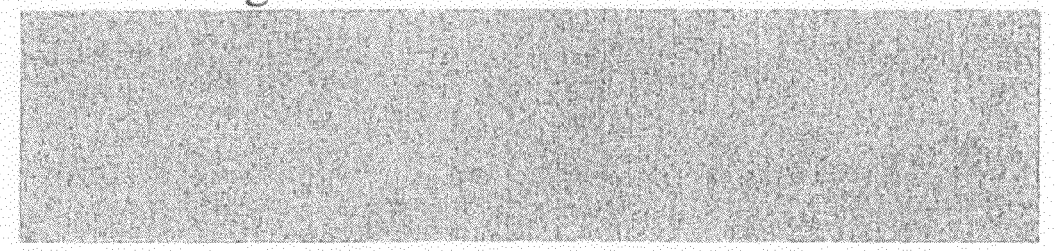
Figure 13:
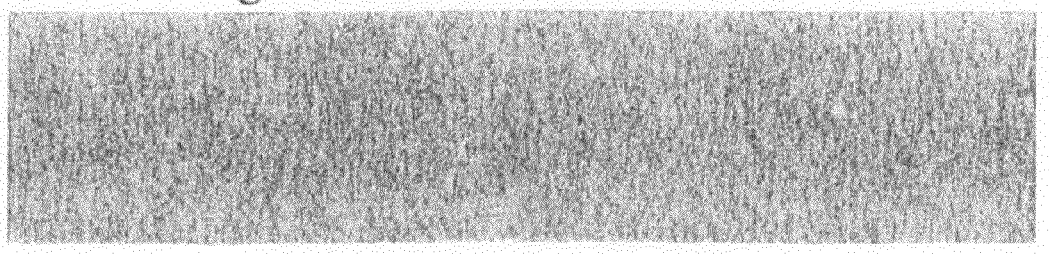

In experiment 2 the same comparison is made between the use of a soft and a hard rod, respectively, but in connection with the coating of paper. FIG. 12 shows coating with a soft rod and FIG. 13 shows coating with a hard rod.

The figures show images of the coating layer developed by a so called heating test.

In the heating test, the coated surface is moistened by a solution of about 10% ammonium chloride. This chemical will make the cellulose fibres darken as the paper is heated to about 300-400° C. by a heating gun or in an oven. The white coating mix will then appear in contrast to the dark underlayer. This test method clearly shows how the coating layer is distributed over the paper surface.

The results of these comparisons are shown in FIGS. 10-13. It is clear from the patchiness of the images that a rod with a soft surface (see FIGS. 10 and 12) will result in a layer of considerably more even thickness than a hard rod (see FIGS. 11 and 13) of conventional type. It must be considered that the result is surprisingly much better when using a soft rod according to the invention.

Figure 14:
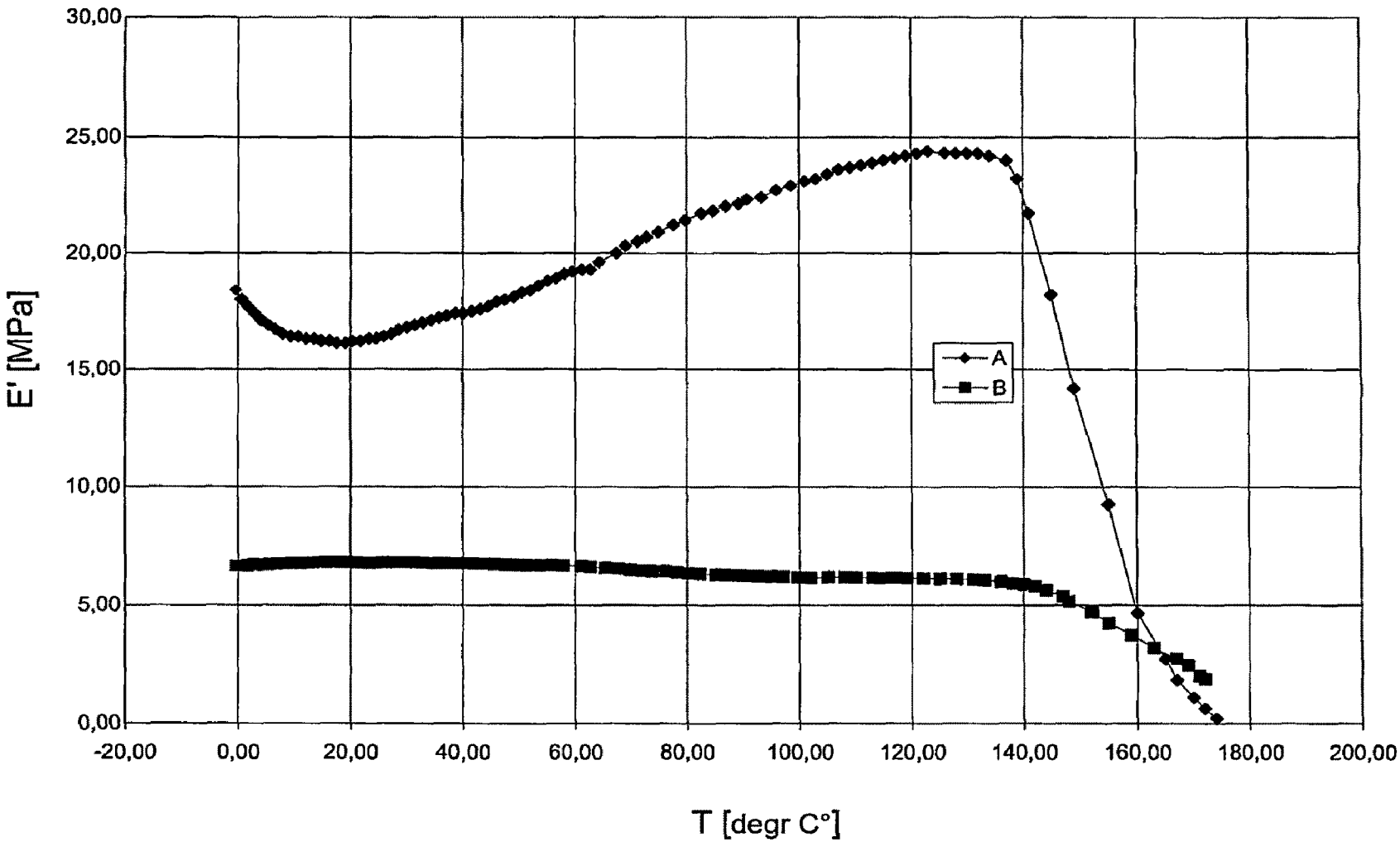
FIGS. 14 and 15 show graphs over tests made with different types of materials differing in modulus of elasticity at different frequencies.
Figure 15:
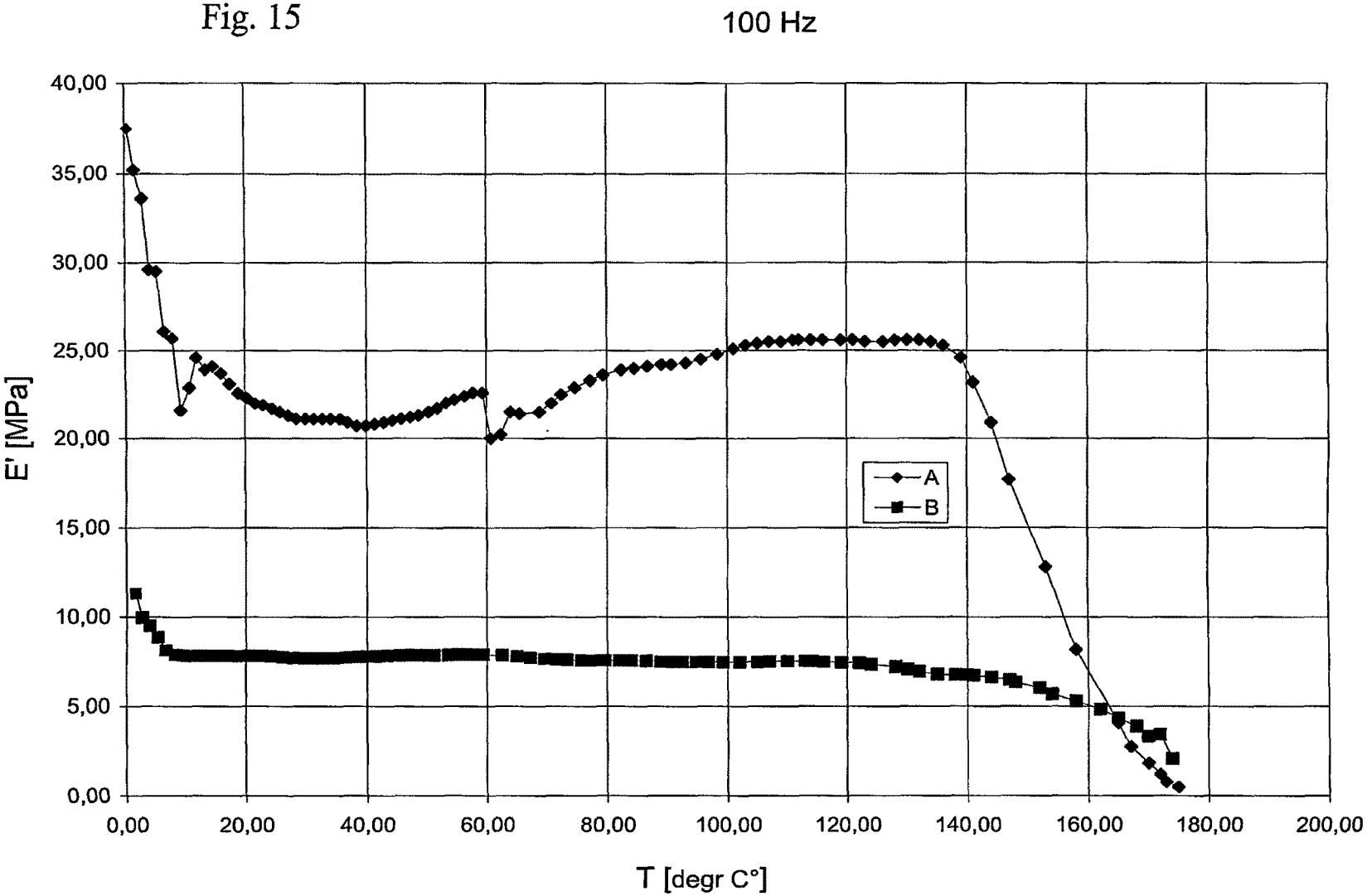

FIGS. 14 and 15 show two graphs having the same magnitudes on the axes, i.e. modulus of elasticity on the y axis and temperature on the x axis. FIG. 14 shows the results of changes in the modulus of elasticity when the material is influenced by a frequency of 1 Hz, and FIG. 15 shows the corresponding values at a frequency of 100 Hz. Both graphs compare the same type of material, both having a Shore A of 70. However, the upper curve shows a material that having higher modulus of elasticity and the lower curve shows a material having a lower modulus of elasticity. Tests have shown that the material having a lower modulus of elasticity will give considerably much better results in respect of covering of the fibres/"puttying effect" than the material having a higher modulus of elasticity. It is clear from the graphs that a material having a modulus of elasticity of below 15 N/mm$^2$ at 20° C. is considerably more stable in respect of changes in modulus of elasticity at different temperatures as compared with a material the modulus of elasticity of which is above 15 N/mm$^2$, and this is probably a part of the explanation why the puttying effect is decreased when using a material of lower modulus of elasticity. It is also clear that it is advantageous to use a material the modulus of elasticity of which is below 15 N/mm$^2$, preferably between 0.1 and 10, at a frequency of 1-100 Hz and a temperature of 20-80° C. In this context, it should be noted that revolving rods are generally used in environments in which the temperature is in principal always within the range of 20-80° C.

An additional aspect that can be illustrated in connection with the comparison made between the two materials, in which the material used in the test and having a higher modulus of elasticity is a type of polyester material, while the material having a lower modulus of elasticity can be categorised as a polyether material (having a larger amount of cross-linked chains of molecules), is the ability of the material to rebound, so called resiliency or rebound elasticity. In standard test, in which a thickness of 12.5 mm of the material is used and in which a weight is dropped from a height of 400 mm, a rebound of about 30% is achieved when using the material having the higher modulus of elasticity, while a rebound of about 70-80% is achieved for the material having the lower modulus of elasticity, the latter material having been shown to result in considerably less puttying effect than the material having the higher modulus of elasticity. Hence, this indicates that the rebound should be more than 40%, preferably 50%, in order to minimise the problem of puttying.

The invention is not limited to the examples described above but may be varied within the scope of the claims. The person skilled in the art will hence realise that the revolving rod according to the invention in some applications can be made of a homogeneous material having a surface hardness according to the invention. The person skilled in the art will also realise that many types of combinations of the core 11 and the surface coating 15 can be used, e.g. in order to achieve different types of properties. It is realised in this respect that it can be desirable in some cases to have more than one surface coating outside the core, e.g. a hard core having a first softer surface coating and on top of that a harder surface coating having a hardness according to the invention. It is furthermore realised that the cross-sectional shape and constitution of the core can be varied widely, e.g. by being made of a composite material having a complex hole configuration e.g. with the purpose of achieving a very good bending stiffness. In addition, it is realised that the concept of a dosing device should be interpreted widely, comprising all types of dosing on and/or coating of a web, and that the soft revolving rod thereby can be positioned within wide frames, e.g. directly against a counter pressing roll or a transfer roll. Similarly, it is realised that the concept of surface coating should be interpreted widely, i.e. comprising an embodiment made of a single homogeneous material.

The invention claimed is:

1. A dosing device for the application of a coating mix onto a running web, which device comprises:

a rod that is supported revolvingly over its entire length in a rod cradle; and a pressing device acting on the rod cradle and producing a pressure of the rod onto the web and onto a counter pressing device of the web, wherein the rod is provided with a wear resistant surface coating with a hardness of more than 10 and less than 100 according to Shore A, and the modulus of elasticity of the surface coating is less than 15 N/mm$^2$.

2. A dosing device according to claim 1, wherein the surface coating has a hardness of about 30 to 95 Shore A.

3. A dosing device according to claim 1, wherein the surface coating is made of an organic polymer.

4. A dosing device according to claim 3, wherein the organic polymer comprises at least one of polyurethanes, styrene butadiene polymers and polyolefins.

5. A dosing device according to claim 4, wherein the organic polymer is a polyurethane.

6. A dosing device according to claim 1, wherein the rod comprises a rod core having an outer diameter (D) in the range of 6-100 mm.

7. A dosing device according to claim 6, wherein the thickness of the surface coating is in the range of 0.5-20 mm.

8. A dosing device according to claim 1, wherein the modulus of elasticity of the surface coating is 0.1-10 $N/mm^2$.

9. A dosing device according to claim 1, wherein said counter pressing device is a counter pressing roll, the surface of which having a hardness corresponding to steel, or harder.

10. A dosing device of coating a web according to claim 1, wherein said counter pressing device is a coating blade.

11. A dosing device according to claim 1, wherein said counter pressing device is a revolving rod.

12. A dosing device according to claim 1, wherein the coating mix is applied by a roll coating device comprising at least one rubber coated transfer roll and at least one dosing gravure roll in contact with said revolving rod for final dosing of the coating mix.

13. A method of coating a web, comprising:

providing a revolving rod that is supported revolvingly over its entire length in a rod cradle, wherein the rod is provided with a wear resistant surface coating with a hardness of more than 10 and less than 100 according to Shore A, and the modulus of elasticity of the surface coating is less than 15 $N/mm^2$;

providing a running web;

providing a pressing device acting on the rod cradle and producing a pressure of the rod onto the web and onto a counter pressing device of the web; and applying a coating mix onto at least one side of the web running upwards or downwards, said coating mix being applied onto at least one side of said web by a pre-dosing device that is provided with a circulation system for recirculation of a surplus of coating mix, and is finally dosed in a nip formed between a final dosing device and a counter pressing device, wherein said final dosing device comprises the revolving rod.

14. The method according to claim 13, wherein a doctor is arranged at the counter pressing roll.

15. The method according to claim 14, wherein said coating mix is applied onto both sides of said web.

16. The method according to claim 15, wherein said revolving rod has a surface coating with a hardness of more than 10 and less than 100 Shore A.

17. The method according to claim 13, wherein the modulus of elasticity of the surface coating is 0.1-10 $N/mm^2$.

* * * * *